US006091914A

United States Patent [19]

Yoo

[11] Patent Number: 6,091,914

[45] Date of Patent: Jul. 18, 2000

[54] LIQUID DEVELOPER CONCENTRATION MEASURING APPARATUS OF AN IMAGE PROCESSOR

[75] Inventor: Yong-Baek Yoo, Suwon, Rep. of Korea

[73] Assignee: SamSung Electronics Co., Ltd., Suwon, Rep. of Korea

[21] Appl. No.: 09/306,889

[22] Filed: May 7, 1999

[30] Foreign Application Priority Data

May 8, 1998 [KR] Rep. of Korea ..... 98 16519
Feb. 25, 1999 [KR] Rep. of Korea ..... 99 6289

[51] Int. Cl.[7] ..... G03G 15/10

[52] U.S. Cl. ..... 399/57; 118/689

[58] Field of Search ..... 399/30, 57, 58, 399/59, 61, 62, 64; 118/690, 691, 689

[56] References Cited

U.S. PATENT DOCUMENTS

| | | | |
|---|---|---|---|
| 4,204,766 | 5/1980 | Harada | 399/57 X |
| 5,706,095 | 1/1998 | Rathbun | 399/57 X |
| 5,897,240 | 4/1999 | Yoo | 399/58 |
| 5,933,685 | 8/1999 | Yoo | 399/57 |

*Primary Examiner*—William J. Royer
*Attorney, Agent, or Firm*—Robert E. Bushnell, Esq.

[57] ABSTRACT

An apparatus for measuring the concentration of a liquid developer of an image processor includes: a housing; a rotating roller disposed inside the housing, a driving source for rotating the roller; a developer supplier for supplying the developer to the roller such that a developer film can be formed as the roller rotates, and a sensor for sensing an amount of light transmitted through the developer film by directing light to the developer film and receiving the light transmitted through the developer film.

20 Claims, 4 Drawing Sheets

LIQUID DEVELOPER CONCENTRATION MEASURING APPARATUS OF AN IMAGE PROCESSOR

CLAIM OF PRIORITY

This application makes reference to, incorporates the same herein, and claims all benefits accruing under 35 U.S.C. §119 from applications for DEVELOPER CONCENTRATION MEASURING APPARATUS OF LIQUID PRINTER earlier fled in the Korean Industrial Property Office on the $8^{th}$ of May 1998 and there duly assigned Ser. No. 16519/1998, and for DEVELOPER CONCENTRATION MEASURING APPARATUS OF LIQUID PRINTER earlier filed in the Korean Industrial Property Office on the $25^{th}$ of Feb. 1999 and there duly assigned Ser. No. 6289/1999.

BACKGROUND OF THE INVENTION

1. Field of the Invention

The present invention relates to an apparatus for measuring the concentration of a liquid developer of an image processor such as a printer, and more particularly, to an apparatus for measuring the concentration of a liquid developer of an image processor by measuring the amount of light transmitted through the developer.

DESCRIPTION OF THE RELATED ART

In an image processor, an electrostatic latent image is formed by selectively scanning a laser beam onto a photoreceptor medium such as a photoreceptor belt or photoreceptor drum and the electrostatic latent image is developed by a developer which is a mixture of toner and a liquid carrier in a predetermined ratio to form a toner image. Also, the image processor is equipped with an apparatus for measuring the concentration of the developer to determine whether the concentration is appropriate.

According to a conventional concentration measuring apparatus of a cell type, a light source and a photodetector are installed on a developer supply path to be separated from each other and the developer is made to pass therebetween. Then, light is emitted from the light source through the developer and a change in the amount of light received by the photodetector is detected so that the concentration of the developer is measured.

However, in the case of developer having low transmissivity, the width of a cell through which the developer passes such that the light emitted from the light source can be transmitted through the developer and be detected by the photodetector must be narrow. Thus, the narrow cell can affect the flow of developer and can easily be contaminated so that an error can be generated in measuring the concentration of the developer.

SUMMARY OF THE INVENTION

To solve the above problems, it is an objective of the present invention to provide an apparatus for measuring the concentration of a liquid developer of an image processor having an improved structure in which a developer film of a predetermined thickness is formed on a surface of a rotating roller disposed in a housing so that the concentration of the developer can be measured by measuring the amount of light transmitted through the film.

Accordingly, to achieve the above objective, there is provided an apparatus for measuring the concentration of a liquid developer of an image processor, which comprises: a housing; a roller rotatably disposed inside the housing; a driving source for rotating the roller; a developer supplier for supplying the developer to the roller such that a developer film can be formed as the roller rotates; and a sensor for sensing an amount of light transmitted through the developer film by directing light to the developer film and receiving the light transmitted through the developer film.

It is preferable in the present invention that the developer supplier comprises: a supply portion filled with a developer to a predetermined level; and a partition disposed inside the housing for sectioning the supply portion and the roller, at least part of the roller being submerged in the developer supplied flowing over the partition from the supply portion.

It is preferable in the present invention that the developer concentration measuring apparatus further comprises a guide member for guiding the developer flowing over the partition, the guide member having one end thereof coupled to the partition and another end adjacent to a surface of the roller.

It is preferable in the present invention that the guide member is contacts the surface of the roller, the guide member cleaning the surface of the roller.

It is preferable in the present invention that the guide member is slanted.

It is preferable in the present invention that the developer concentration measuring apparatus further comprises a wall of a predetermined height to be separated from a side wall of the housing, the wall contacting both sides of the guide member.

It is preferable in the present invention that the developer concentration measuring apparatus further comprises a shutting member disposed in the housing directly above the partition to form a gap of a predetermined distance with the partition so that the developer is prevented from irregularly flowing to the roller from the supply portion.

It is preferable in the present invention that the developer concentration measuring apparatus further comprises a supply pipe disposed at a lower portion of the supply portion for allowing the developer to flow into the housing; and a buffer member disposed at the supply portion for buffering the flow of the developer supplied from the supply pipe.

According to the characteristic feature of the present invention, the sensor comprises: a reflection member provided on at least part of a surface of the roller; a light source installed outside the roller for directing light to the developer film formed on the reflection member; and a main photodetector installed to one side of the light source for receiving the light transmitted through the developer film and reflected by the reflection member.

According to another characteristic feature of the present invention, at least part of the roller is formed of a transparent member and the sensor comprises: a light source installed either inside or outside the roller for directing light to the developer film formed on the translucent member; and a main photodetector installed to face the light source for detecting the light transmitted by the developer film.

It is preferable in the present invention that the light source emits light which is in an infrared wavelength range.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
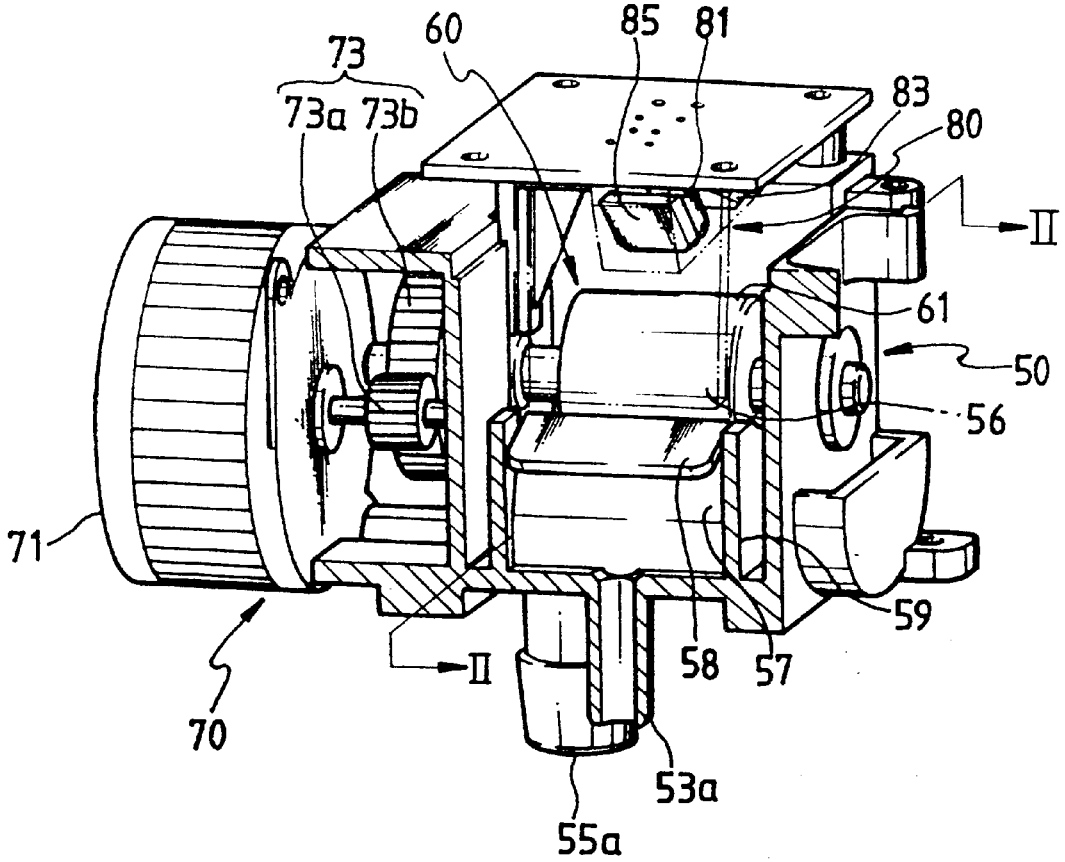
FIG. 1 is a partially cut-away perspective view showing an apparatus for measuring the concentration of a liquid developer according to a preferred embodiment of the present invention.
Figure 2:
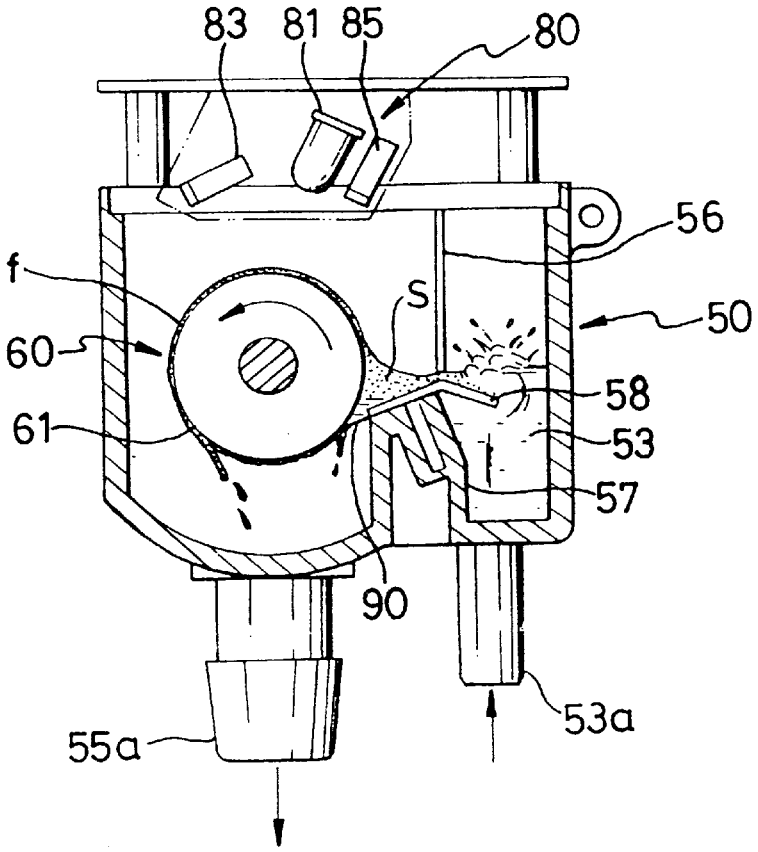
FIG. 2 is a sectional view taken along line II—II of FIG. 1.

Referring to FIGS. 1 and 2, an apparatus for measuring the concentration of a developer according to a preferred embodiment of the present invention, includes a housing 50, a rotating roller 60 installed inside the housing 50, a driving source 70 for driving the rotation of the roller 60, a developer supplier for supplying the developer onto the roller 60 to form a developer film as the roller 60 rotates, and a sensor 80 for directing a light beam to the developer film and receiving the light beam passing through the developer film.

The housing 50 includes a supply portion 53 which is filled with developer to a predetermined level. The developer flows in the supply portion 53 via a supply pipe 53*a*. A valve (not shown) for regulating the amount of developer supplied is installed at the supply pipe 53*a*, which opens only when the concentration of the developer is measured. The developer flowing in the supply portion 53 via the supply pipe 53*a* is exhausted to a reservoir (not shown) via an exhaust pipe 55*a*. Preferably, the size of the exhaust pipe 55*a* is large enough so that no developer stays in the housing 50.

The supply portion 53 and the roller 60 are spatially separated by a partition 57 formed to have a predetermined height from the bottom surface of the housing 50. Accordingly, when there is a sufficient amount of developer supplied to the supply portion 53 through the supply pipe 53*a*, the developer in the supply portion 53 flows toward the roller 60 beyond the partition 57.

A wall 59 of a predetermined height is formed to be separated from a side wall of the housing 50 at least one side of the supply portion 53. When there is an excess amount of the developer supplied to the supply portion 53 through the supply pipe 53*a*, the wall 59 allows the excess developer to overflow into a space between the wall 59 and the side wall of the housing 50. Preferably, the wall 59 is formed to extend to the side portions of the roller 60. Accordingly, the developer can contact the roller 60 at about a constant height, as the developer supplied toward the roller 60 overflows into a space between the wall 59 installed to extend to the side portions of the roller 60 and the side wall of the housing 50.

Preferably, a buffer member 58 for reducing the flow rate of the developer supplied from the supply pipe 53*a* is installed at the supply portion 53 to protrude from the partition 57. The buffer member 58 can be installed on the wall 59 and/or the side wall of the housing 50.

A shutting member 56 is installed at the ceiling of the housing 50 to make a gap of a predetermined width from the partition 57. The shutting member 56 prevents the developer from a defective flow from the supply portion 53 to the roller 60 generated due to malfunction of a pump (not shown) and an unstable flow which is caused as the developer flows from a relatively narrower supply pipe 53*a* to a relatively larger supply portion 53. Thus, the level of the developer at one side of the roller 60 becomes stable and the change in the thickness of the developer film is minimized so that accurate measurement of the concentration of the developer is possible.

To clean the roller 60 which rotates after the developer film formed on the surface of the roller 60 is detected by the sensor, a cleaning member such as a blade 90 is installed to be capable of contacting the surface of the roller 60.

One end of the blade 90 is installed at the upper portion of the partition 57 and the other end thereof is in contact with the surface of the roller 60. Both side ends of the blade 90 contact the wall 59. Thus, the blade 90 functions as a guide member for guiding the developer flowing in over the partition 57 and simultaneously forms a predetermined space S together with the wall 59. Preferably, the blade 90 is installed to be slanted toward the lower portion of the roller 50. In this case, the developer supplied from the supply portion 53 flows toward the roller 60 by being guided along the blade 90 and remains in the space S to a predetermined height. That is, the developer flowing through the gap between the partition 57 and the shutting member 56 hardly flows toward the lower portion of the roller 60 by being restricted by the blade 90 contacting the surface of the roller 60. Here, the depth to which one side of the roller 60 is submerged in the developer remaining in the space S is approximately determined by relative installation positions of the gap and the roller 60. Here, the blade 90 can be installed to be adjacent to the roller 60 so that it functions as the guide member only, while a cleaning member is additionally installed.

Since excess developer naturally overflows over the wall 59 as the level of the developer flowing into the space S rises, the level of the developer in the space S is maintained to be nearly constant.

In the above state, when the roller 60 is rotated counterclockwise by driving the driving source 70, as shown in FIG. 2, a film f of the developer having a predetermined thickness is formed on the surface of the roller 60. Here, the more the level of the space S becomes constant, the more the thickness of the film f of the developer can be maintained to be uniform. Also, the thickness of the film f of the developer is determined by a rotational linear speed of the roller 60, the angle at which the roller 60 sinks into the developer in the space S, and the viscosity of the developer, particularly kinetic viscosity. For example, when the concentration of the developer is low, the viscosity of the developer is lowered so that the thickness of the film f becomes thin.

Figure 3:
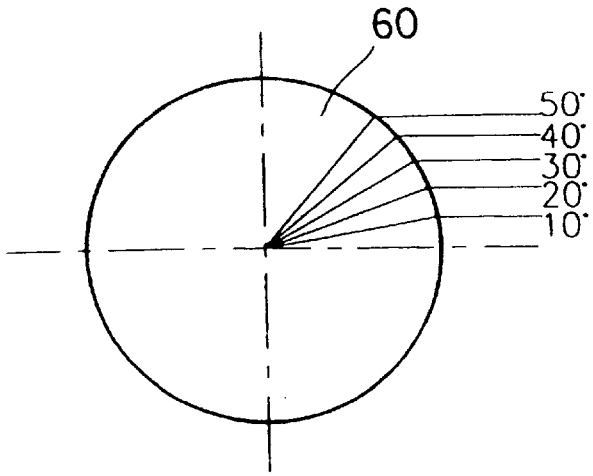
FIG. 3 is a view showing the relationship between the depth to which the roller shown in FIG. 1 is submerged in a developer and the angle that is obtained by converting the above depth.

FIG. 3 shows the relationship between the depth to which the roller 60 is submerged in the developer in the space S and the angle θ. As shown in the drawing, when the roller 60 is submerged in the developer at the respective angles of 0°, 10°, 20°, 30°, 40°, and 50° with respect to the horizontal direction, the thickness h of the film f of the developer formed on the roller 60 is shown in the table below.

| θ | h (μm) | θ | h (μm) |
|---|---|---|---|
| 0° | 85 | 30° | 110 |
| 10° | 95 | 40° | 117 |
| 20° | 100 | 50° | 126 |

Here, the concentration of the developer is about 3 wt % and the kinetic viscosity thereof is about 1.6 $cm^2$/sec and the color thereof is magenta. Also, the rotational linear speed of the roller 60 is about 127 mm/sec.

When the concentration of the developer and the depth to which the roller 60 is submerged in the developer are constant, the thickness h of the film f of the developer varies according to the rotational linear speed of the roller 60. Also, when the depth to which the roller 60 is submerged in the developer and the rotational linear speed of the roller 60 are constant, the thickness h of the film f of the developer varies according to the concentration of the developer. When all of the above conditions are constant, the thickness h of the film f of the developer varies according to the color of the developer such as yellow, magenta, cyan, and black. Thus, the thicknesses of the film f of the developer according to the rotational linear speed of the roller 60, the depth to which the roller 60 is submerged in the developer in the space S, and the concentration of the developer, and according to the color of the developer, and the changes in the amount of the light transmitting the film f of the developer can be stored in a lookup table as reference data. The range of concentrations of the developer in which print quality can be appropriately maintained is 2.5–3.5 wt %.

In the apparatus for measuring the concentration of the developer according to the preferred embodiment of the present invention, when the range of concentrations of the developer is set to be about 2.5–3.5 wt %, the rotational linear speed of the roller 60 is set to be 122 rpm, and a lateral surface of the roller 60 is set to be submerged in the developer in the space S to a depth corresponding to about 10°–20°, a developer film having a thickness of about 50–100 μm can be formed on the surface of the roller 60. Thus, the concentration of black developer exhibiting a relatively low light transmissivity can be measured.

The driving source 70 includes a driving motor 71 such as a stepping motor which is capable of driving at a constant speed and a reduction gear assembly 73 which reduces the rotation speed of the driving motor 71 and transfers the rotational force to the roller 60. The driving source 70 can further include an encoder (not shown) for detecting the number of rotations of the driving motor 71 and a controller (not shown) for controlling the rotational linear speed of the roller 60.

The reduction gear assembly 73 is comprised of a first gear 73*a* coupled to a rotation shaft of the driving motor 71 and a second gear 73*b* having more teeth than the first gear 73*a* which is installed at the rotation shaft of the roller 60 and engaged with the first gear 73*a*.

In the present embodiment, a reflection type sensor 80 for detecting a change in the amount of light transmitted through the developer film formed on the surface of the roller 60 by a light source and a photodetector installed out of the roller 60 is adopted.

The sensor 80 includes a reflection member 61 installed on at least a portion of the surface of the roller 60, a light source 81 for emitting light to the developer film formed on the reflection member 61, and a main photodetector 83 installed at the side of the light source 81 for receiving the light reflected by the reflection member 61.

The light source 81 is preferably installed above the roller 60 such that it can emit light to the developer film formed on the uppermost portion of the roller 60. This is because light can be emitted to a portion where the change in the thickness of the developer film is minimized within a predetermined area.

Preferably, a light emitting diode (LED) or a semiconductor laser is used as the light source 81. Also, the light source 81 emits a ray of light in an infrared wavelength range about 780 nm or more. The ray of light in the infrared wavelength range exhibits a relatively higher transmissivity with respect to developers of yellow, magenta, and cyan colors. The black developer generally exhibits a low light transmissivity throughout ranges of infrared, visible, and ultraviolet wavelengths. However, a desired light transmissivity can be obtained by forming a thin developer film on the surface of the roller 60. Thus, the concentration of developer regardless of color of the developer can be measured by adopting the light source 81 emitting the ray of light in the infrared wavelength range.

Also, a light emitting diode emitting a white light ray can be used as the light source 81. It is also possible to adopt a light source emitting a ray of light in a wavelength range corresponding to the color of each developer of which the concentration is to be measured.

Figure 4A:
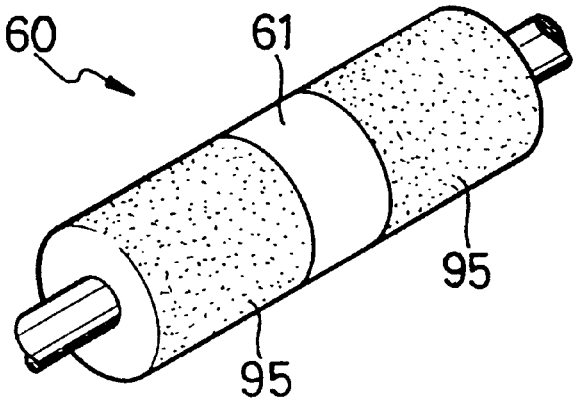
FIGS. 4A and 4B are perspective views showing the light source and the roller, each having a limiting member, respectively.
Figure 4B:
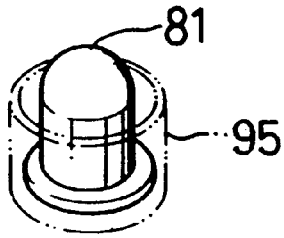

Particularly, when the light source 81 is a light emitting diode, as shown in FIGS. 4A and 4B, a restricting member 95 for restricting a reflection range of light is preferably installed on the surface of the roller 60 and/or around the light source 81. The restricting member 95 is used such that the ray of light emitted from the light emitting diode can be emitted on the developer film within a predetermined area and the reflected light can only be detected by the photodetector 83.

A sub-photodetector 85 is installed adjacent to the light source 81 to monitor an output of the light from the light source 81 by detecting part of the light emitted from the light source 81. When the driving current of the light source 81 is controlled by feeding back a detection signal of the sub-photodetector 85 to an apparatus (not shown) for driving the light source 81, the output of light from the light source 81 becomes stable. Also, when a detection signal of the main photodetector 83 is corrected with the detection signal of the sub-photodetector 85, the result is the same as in a case in which the amount of light is uniformly emitted on the developer film regardless of the change in the amount of light.

Preferably, the sensor 80 further includes a concentration calculator (not shown) for comparing the detection signal of the main photodetector 83 with the reference data of the lookup table. Also, to minimize the effect of external light on the developer concentration measuring apparatus, the housing 50 is formed of an opaque material or the outer surface is treated to be black.

The operation of the liquid developer concentration measuring apparatus of an image processor according to a preferred embodiment of the present invention will be described as follows.

First, to measure the concentration of the developer supplied to the developing unit, the developer stored in the reservoir is supplied to the supply portion 53 via the supply pipe 53*a*. Part of the developer in the supply portion 53 flows toward the roller 60 through the gap between the partition 57 and shutting member 56. The remaining developer flowing over the wall 59 down to the bottom of the housing 50 and is exhausted via the exhaust pipe 55*a*. The developer escaping through the gap is limited by the blade 90 contacting the roller 60 and accordingly remains in the space S to have a predetermined level. Thus, the lateral surface of the roller 60 becomes submerged in the developer at the predetermined level. Here, if the amount of the developer flowing in through the gap increases, excess developer flows over the wall 59 installed to both sides of the roller 60 and falls down to the bottom of the housing 50. Thus, the excess developer is exhausted through the exhaust pipe 55*a* so that the level of the developer in the space S is uniformly maintained. Under these circumstances, when the roller 60 is rotated by the driving source 70 at a predetermined rotational linear speed, the developer film of a predetermined thickness is formed on the surface of the roller 60. Then, when the sensor 80 is operated, a ray of light emitted by the light source 81 is transmitted through the developer film and reflected by the reflection member 61. The reflected light passes through the developer film again and is detected by the main photodetector 83. During the above process, the concentration calculator compares the detection signal of the main photodetector 83 with the reference data of the lookup table and outputs a developer concentration signal.

As the roller 60 continues to rotate, the developer film formed on the surface of the roller 60 separates from the surface of the roller 60 and falls down to the bottom of the housing 50 due to gravity. Also, part of the developer film remaining on the surface of the roller 60 is cleaned by the blade 90. The developer on the bottom of the housing 50 is exhausted through the exhaust pipe 55*a*.

Figure 5:
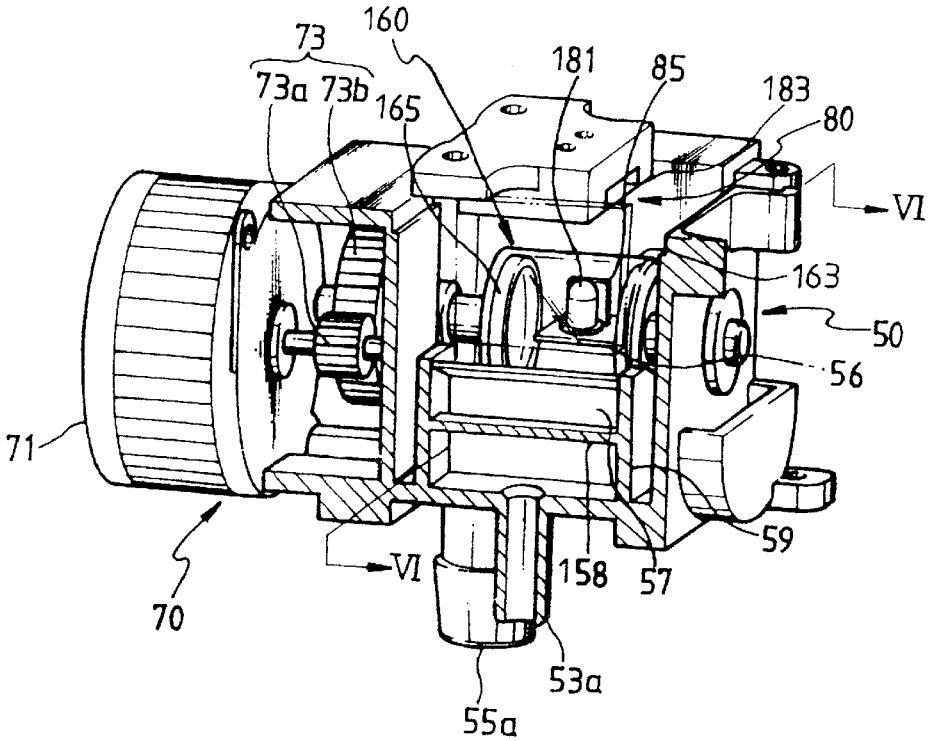
FIG. 5 is a partially cut-away perspective view showing an apparatus for measuring the concentration of a liquid developer according to another preferred embodiment of the present invention.
Figure 6:
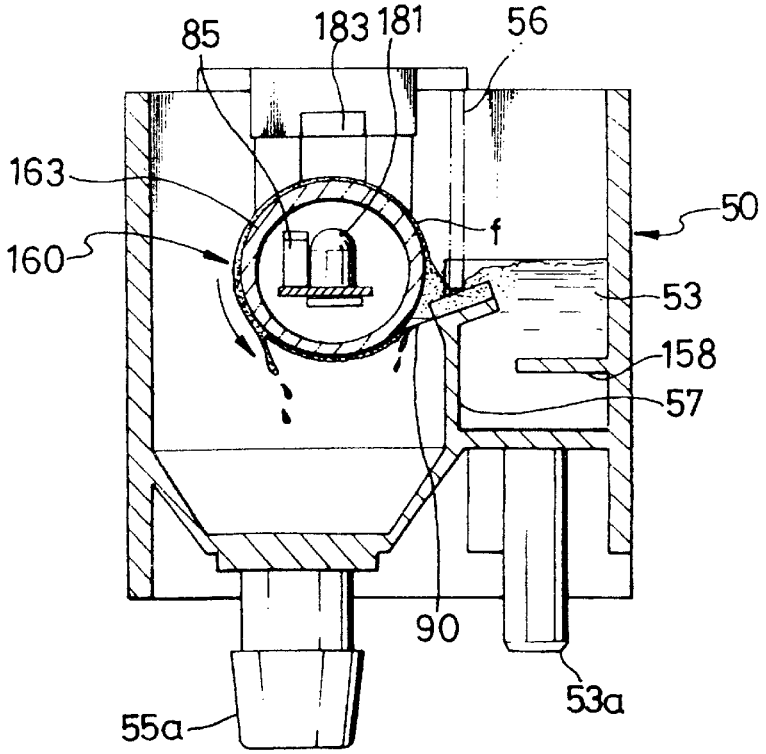
FIG. 6 is a sectional view taken along line VI—VI of FIG. 5.

FIG. 5 is a partially cut-away perspective view showing a liquid developer concentration measuring apparatus of an image processor according to another preferred embodiment of the present invention; and FIG. 6 is a sectional view taken along line VI—VI of FIG. 5. The same reference numerals as those shown in FIGS. 1 and 2 indicate the same elements having the same functions.

In contrast to the above-mentioned preferred embodiment, the developer concentration measuring apparatus according to the present embodiment adopts a transmission type sensor. At least part of a roller 160 is formed of a transparent member 163. That is, the roller 160 is comprised of a body 163 formed of a transparent tube such as a glass tube and a flange 165 installed at both sides of the body 163.

A light source 181 and a main photodetector 183 which are configurational elements of the sensor according to the present embodiment are installed in and out of the roller 160, respectively, to face each other. For example, the light source 181 is installed inside the roller 160 and the photodetector 183 is installed outside the roller 160, and vice versa. Thus, light emitted from the light source 181 is transmitted through the developer film formed on the surface of the roller 160 and the transparent member 163 and is received by the photodetector 183 disposed to face the light source 181. Here, the light source 181 and the photodetector 183 are preferably installed to be approximately perpendicular to the surface of the roller 160 such that light can be emitted to be perpendicular to the developer film. Reference numeral 158 denotes a buffer member installed to protrude from an inside wall of the housing 50.

The developer concentration measuring apparatus of an image processor according to the present invention has the following advantages.

First, a thin developer film is formed on the surface of the rotating roller and the concentration of the developer is measured by measuring the light transmissivity of the developer film. Thus, a problem in the conventional cell type developer concentration measuring apparatus, that is, the developer is prevented from flowing due to a narrow developer supply path can be removed.

Second, the concentration of a black developer exhibiting a low light transmissivity can be measured.

Third, when a light source emitting a ray of light which approximately belongs to the infrared wavelength range is adopted, each concentration of developers of yellow, magenta, and cyan colors in addition to a black developer can be measured.

Fourth, since a cleaning member is installed to be capable of contacting the surface of the roller, contamination on the surface of the roller can be prevented.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An apparatus for measuring the concentration of a liquid developer of an image processor, said apparatus comprising:

a housing;

a roller rotatably disposed inside said housing;

a driving source for rotating said roller;

a developer supplier for supplying the developer to said roller such that a developer film can be formed as said roller rotates;

a sensor for sensing an amount of light transmitted through said developer film by directing light to the developer film and receiving the light transmitted through the developer film; and said developer supplier, comprising:

a supply portion containing a developer to a predetermined level; and a partition installed inside said housing sectioning said supply portion and said roller, at least part of said roller being submerged by any developer flowing over said partition from said supply portion.

2. The apparatus as claimed in claim 1, further comprising a guide member guiding the developer flowing over said partition, said guide member having one end coupled to said partition and another end adjacent to a surface of said roller.

3. The apparatus as claimed in claim 2, said guide member contacting the surface of said roller and cleaning the surface of said roller.

4. The apparatus as claimed in claim 2, said guide member being slanted.

5. The apparatus as claimed in claim 2, further comprising a wall of a predetermined height separated from a side wall of said housing, said wall contacting both sides of said guide member.

6. The apparatus as claimed in claim 1, further comprising a shutting member disposed in said housing directly above said partition to form a gap of a predetermined distance with said partition so that the developer is prevented from irregularly flowing to said roller from said supply portion.

7. The apparatus as claimed in claim 1, further comprising:

a supply pipe disposed at a lower portion of said supply portion for allowing the developer to flow into said housing; and a buffer member disposed at said supply portion for buffering the flow of the developer supplied from said supply pipe.

8. The apparatus as claimed in claim 1, further comprising a wall of a predetermined height separated from a side wall of said housing.

9. The apparatus as claimed in claim 8, said wall being formed to extend toward a side portion of said roller.

10. The apparatus as claimed in claim 1, said sensor comprising:

a reflection member provided on at least part of a surface of said roller;

a light source installed outside said roller for directing light to said developer film formed on said reflection member; and a main photodetector installed to one side of said light source for receiving the light transmitted through said developer film and reflected by said reflection member.

11. The apparatus as claimed in claim 10, said sensor further comprising a sub-photodetector disposed adjacent to said light source for monitoring an output of said light source by detecting part of the light from said light source.

12. The apparatus as claimed in claim 10, further comprising a restricting member installed at at least one of said roller and said light source for restricting a reflection range of light.

13. The apparatus as claimed in claim 10, said sensor directing light to a developer film portion formed on approximately the upper most portion of said roller.

14. The apparatus as claimed in claim 10, said light source emitting light in an infrared wavelength range.

15. The apparatus as claimed in claim 1, comprised of at least part of said roller being formed of a transparent member and said sensor comprises:

a light source installed either inside or outside said roller and directing light to said developer film formed on said transparent member; and a main photodetector installed to face said light source detecting the light transmitted through said developer film.

16. The apparatus as claimed in claim 15, said sensor further comprises a sub-photodetector disposed adjacent to said light source for monitoring an optical output of said light source by detecting part of the light from said light source.

17. The apparatus as claimed in claim 15, farther comprising a restricting member disposed on at least one of said roller and said light source for restricting a range of transmission of light.

18. The apparatus as claimed in claim 15, said sensor being perpendicular to said roller.

19. The apparatus as claimed in claim 15, said light source emitting light in an infrared wavelength range.

20. An apparatus for measuring the concentration of a liquid developer of an image processor, said apparatus comprising:

a housing;

a roller rotatably disposed inside said housing;

a driving source rotating said roller;

a developer supplier supplying the developer to said roller to form a developer film as said roller rotates;

a sensor sensing an amount of light transmitted through said developer film by directing light to the developer film and receiving light transmitted through the developer film; and said sensor comprising:

a reflector provided on at least part of a surface of said roller;

a light source installed outside said roller directing light to said developer film formed on said reflector; and a main photodetector installed to one side of said light source, receiving light transmitted through said developer film and reflected by said reflector.

* * * * *